US005673107A

United States Patent [19]

Masuda

[11] Patent Number: 5,673,107

[45] Date of Patent: Sep. 30, 1997

[54] SERIAL-TYPE ELECTROPHOTOGRAPHIC APPARATUS

[76] Inventor: Syuzou Masuda, c/o Fujitsu Limited, 1015, Kamikodanaka, Nakahara-ku, Kawasaki-shi, Kanagawa, 211, Japan

[21] Appl. No.: 299,304

[22] Filed: Sep. 1, 1994

[30] Foreign Application Priority Data

Nov. 19, 1993 [JP] Japan ..... 5-290448
Jul. 4, 1994 [JP] Japan ..... 6-152333

[51] Int. Cl.[6] ..... G03G 15/00

[52] U.S. Cl. ..... 355/210; 347/112; 347/140; 355/219; 355/235; 400/118.2

[58] Field of Search ..... 355/210, 211, 355/219, 233, 235; 347/124, 112, 140; 400/118.2, 320, 118.3

[56] References Cited

U.S. PATENT DOCUMENTS

| | | | |
|---|---|---|---|
| 4,116,557 | 9/1978 | Kushima et al. | 355/235 |
| 4,403,849 | 9/1983 | Burger et al. | 355/235 |
| 4,435,068 | 3/1984 | Landa | 355/235 X |
| 4,845,519 | 7/1989 | Fuse | 347/112 |
| 4,897,677 | 1/1990 | Lai | 355/211 X |
| 5,196,870 | 3/1993 | Itoh et al. | 347/140 X |

FOREIGN PATENT DOCUMENTS

| | | |
|---|---|---|
| 56-89576 | 7/1981 | Japan . |
| 59-192586 | 10/1984 | Japan . |
| 60-196361 | 10/1985 | Japan . |

*Primary Examiner*—Nestor R. Ramirez

[57] ABSTRACT

A moving body moves in reciprocation in directions perpendicular to a feeding direction of a chart. An image carrier is mounted on the moving body and rotates in synchronism with a movement of the moving body. A charging unit is mounted on the moving body and changes the image carrier. A developing unit is mounted on the moving body and develops an electrostatic latent image formed by irradiating the image carrier charged by the charging unit with the light. A voltage dividing unit moving in synchronism with the moving body divides a predetermined voltage and supplies the divided voltages to at least the charging unit and the developing unit. An electric charge supplying unit may be used to supply electric charges to a holding unit for holding the electric charges under various conditions of the moving body.

16 Claims, 15 Drawing Sheets

SERIAL-TYPE ELECTROPHOTOGRAPHIC APPARATUS

BACKGROUND OF THE INVENTION

The present invention relates to an electrophotographic apparatus for performing a print on a chart by moving a carriage in directions perpendicular to a feeding direction of the chart, which carriage includes a charging unit, an exposure unit and developing rollers.

Hitherto, for instance, a line printer has been devised as an electrophotographic apparatus. The line printer effects the print on the chart by feeding the chart without moving an electrophotographic process including a charging unit, an optical head and developing rollers and without shifting a center of rotation of a photosensitive drum. This line printer is, however, expensive.

In recent years, the electrophotographic apparatus has been demanded in terms of its down-sizing and a reduction in price. Accordingly, there has hitherto been employed the electrophotographic apparatus effecting the print while making the chart static. This electrophotographic apparatus has a carriage mounted with the above electrophotographic process, which carriage moves in reciprocation in directions perpendicular to a feeding direction of the chart.

The carriage moves in the directions perpendicular to the feeding direction of the chart while being guided by shafts. The carriage has an image carrier. The image carrier rotates at the same peripheral speed as a moving velocity of the carriage. Then, the charging unit uniformly charges the surface of the image carrier, thereby forming an electrostatic latent image thereon through an exposure unit.

Next, the electrostatic latent image is transformed into a visible toner image by the developing rollers. Further, the toner image formed on the image carrier is transferred onto the chart by means of a transferring unit disposed in a face-to-face relationship with the image carrier, with the chart being sandwiched in therebetween. Subsequently, residual toners on the image carrier are scraped off by a cleaner.

The thus cleaned surface of the image carrier is again charged by the charging unit, and the same printing process as the above-mentioned is repeatedly performed. Then, when finishing the print to a predetermined width, the chart is fed by a predetermined quantity by feeding rollers. Further, the carriage is returned to a predetermined position, wherein a next print takes place. Moreover, the toner image on the chart is heated and fixed by a fixing unit moving in synchronism with the movement of the carriage.

By the way, when the print is effected on the above-stated chart, high voltages different from each other are applied from a power supply unit via cables to the charging unit, the developing rollers and doctor blades disposed in the vicinity of the developing rollers, which are mounted on the carriage. There voltages on the order of, e.g., −2000 V through +2000 V are applied thereto.

However, the carriage moves, and hence, there is elongated each cable connected from a power supply unit to each unit such as a charging unit or the like. For this reason, there exists a possibility of causing a leakage between a plurality of cables. As a result, the apparatus lacks the safety.

Further, an inverter device supplies an electric current switched at a high speed to a heating coil within the fixing unit. In this case, since the inverter device is provided on the side of the power supply unit, the cable extending from the inverter device to the fixing unit elongates. In this state, the electric current switched at the high speed flows through the cable, resulting in a large loss of the electric current. Consequently, the electric current supplied to the fixing unit becomes small in quantity enough not to drive the fixing unit. Further, large noises are produced due to the electric current when switched at the high speed.

On the other hand, known techniques of this type of electrophotographic apparatus are disclosed in, e.g., a first known example (Japanese Patent Laid-Open No. 56-89576), a second known example (Japanese Patent Laid-Open No.60-196361) and a third known example (Japanese Patent Laid-Open No.59-192586). According to the first known example, down-sizing of a non-impact printing element is attained by use of an aperture board formed with a plurality of through-holes in a direction orthogonal to a printing line. According to the second known example, image plotting and printing are performed on the entire surface of the chart by repeatedly effecting mechanical subscanning of an electrostatic recording printer head. According to the third known example, the down-sizing of the apparatus is attained by forming printing device units into one united body and constructing a rotary shaft of a photosensitive drum so as to be scan-movable along crosswise directions of the chart.

Any of the techniques in those known examples did not obviate the problems described above.

SUMMARY OF THE INVENTION

It is a primary object of the present invention to provide an inexpensive electrophotographic apparatus exhibiting a high reliability by reducing both a cable-to-cable leakage and noises.

An electrophotographic apparatus according to a first invention comprises a moving body, an image carrier, a charging unit, a developing unit and a voltage dividing unit. The moving body moves in reciprocation in directions perpendicular to a feeding direction of a chart. The moving body is, e.g., a carriage or the like. The image carrier is mounted on the moving body and rotates in synchronism with a movement of the moving body. The image carrier is, e.g., a photosensitive drum or the like.

The charging unit is mounted on the moving body and charges the image carrier, thereby applying an uniform electric potential to the surface of the image carrier. For instance, the charging unit is a charging roller, a charging brush, etc.

The developing unit is mounted on the moving body and develops the electrostatic latent image formed by irradiating the image carrier charged by the charging unit with the light. The developing unit is, e.g., a developing roller or the like.

The voltage dividing unit moves in synchronism with the moving body. The voltage dividing unit divides a predetermined voltage and supplies the divided voltages to the charging unit and the developing unit.

The electrophotographic apparatus according to the present invention is constructed of the above indispensable constructive elements. Concretely, these constructive elements may be those which follow.

The voltage dividing unit is constructed by connecting a plurality of resistances in series and fetches the divided voltages from one terminal of the respective resistances. Note that the voltage dividing unit may be constructed by connecting a plurality of capacitors in series. Further, the electrophotographic apparatus may include a power supply unit for supplying the predetermined voltage via the cable.

Moreover, the electrophotographic apparatus may include a fixing unit and a drive unit for driving the fixing unit. The fixing unit moves in synchronism with the moving body and fixes a developed image formed on the chart.

The drive unit may move in synchronism with the moving body. Further, the drive unit may include a rectifying unit, an inverter section and a resonating unit. The rectifying unit rectifies an alternate current given from an AC power supply. The inverter section converts a direct current into the alternate current. The resonating unit, which is connected to the rectifying unit and the inverter section, effects a voltage-resonance.

The resonating unit may move in synchronism with the moving body. The resonating unit and the inverter section may move in synchronism with the moving body.

The resonating unit may be constructed by connecting a capacitor and a coil in parallel, which coil heats the fixing unit. Herein, an element for heating the fixing unit may be an element other than the coil.

Further, an electrophotographic apparatus according to a second invention comprises a moving body, an image carrier, a charging unit, a developing unit, an electric charge supplying unit and a holding unit. The moving body moves in reciprocation in directions perpendicular to a feeding direction of a chart. The image carrier is mounted on the moving body and rotates in synchronism with a movement of the moving body. The charging unit is mounted on the moving body and charges the image carrier. The developing unit is mounted on the moving body and develops the electrostatic latent image formed by irradiating the image carrier charged by the charging unit with the light. The electric charge supplying unit supplies the electric charges. The holding unit mounted on the moving body, when the moving body is in a start-of-print position, holds the electric charges supplied from the electric charge supplying unit but, when the moving body is in an execution-of-print position, applies the held electric charges to the developing unit and the charging unit.

Further, a plurality of holding units may be provided corresponding to at least the developing unit and the charging unit. In addition, the electrophotographic apparatus may include a hold voltage dividing unit. The hold voltage dividing unit is mounted on the moving body and divides an electric potential relative to the electric charge accumulated in the holding unit. The hold voltage dividing unit supplies the divided voltages to the charging unit and the developing unit.

The holding unit is composed of a switch and a capacitor. The switch operates when the moving body is in the start-of-print position but makes non-operation when the moving body is in the execution-of-print position. The capacitor holds the electric charge supplied from the electric charge supplying unit when the switch operates. The capacitor applies the held electric charges to the developing unit and the charging unit when the switch makes the non-operation.

Further, the hold voltage dividing unit is constructed by connecting a plurality of resistances and fetches the divided voltages from one terminal of the respective resistances. The hold voltage dividing unit may be constructed of a plurality of capacitors connected in series.

The moving body may include a resistance and a switch. The switch is connected to the resistance, and the electric charge accumulated in the holding unit is discharged via the resistance by a manipulation from the outside.

Moreover, an electrophotographic apparatus according to a third invention comprises a first operating unit, a second operating unit, a power supply voltage unit and a voltage dividing unit. The first and second operating units are mounted on the moving body and operate when supplied with respective power supply voltages. The power supply voltage unit supplies the first and second operating units with the power supply voltages. The voltage dividing unit, which moves in synchronism with the moving body, divides the power supply voltage given from the power supply voltage unit and supplies the divided voltages to the first and second operating units.

According to the electrophotographic apparatus of this invention, the voltage dividing unit moves in synchronism with the moving body. The voltage dividing unit divides the predetermined voltage and supplies the divided voltages to the charging unit and the developing unit. Accordingly, the power supply unit supplies the voltages to the respective units of the moving body via a small number of cables, and hence the cable-to-cable leakage can be reduced.

Further, the drive unit moving in synchronism with the moving body drives the fixing unit. The electric current is switched at the high speed by the drive unit. Consequently, there decreases such a possibility that the electric current having a high frequency flows in between the moving body and the power supply unit. This results in a decrease in terms of a loss of electric current.

Moreover, the resonating unit moving in synchronism with the moving body performs the voltage-resonance and switches the electric current at the high speed. Accordingly, there decreases a possibility in which the high-frequency electric current switched by the resonating unit flows in between the moving body and the power supply unit. This results in the reduction in the loss of electric current.

Further, holding unit, when the moving body is in the start-of-print position, holds the electric charge supplied from the electric charge supplying unit. The holding unit, when the moving body is in the execution-of-print position, applies the held electric charges to at least the developing unit and the charging unit. A bias voltage can be therefore kept at a fixed voltage during the print. Besides, there is eliminated a necessity for the high-voltage cable led from the power supply unit, resulting in no leakage and no electric shock.

Moreover, the voltage dividing unit divides the electric potential relative to the electric charge accumulated in one holding unit and supplies the divided voltages to the charging unit and the developing unit. That is, the plurality of voltages to be supplied are generated by the single piece of holding unit, and it is therefore possible to provide the small-sized and inexpensive apparatus.

In addition, the switch is connected to the resistance by the manipulation from the outside, thereby discharging the electric charge accumulated in the holding unit via the resistance. Accordingly, there disappears a danger of undergoing the electric shock during the maintenance, and the safety is thus secured.

Further, the voltage dividing unit moving in synchronism with the moving body divides the power supply voltage given from the power supply voltage unit and supplies the divided voltages to the first and second operating units. The first and second operating units mounted on the moving body operate when receiving the supply of the divided voltages.

BRIEF DESCRIPTION OF THE DRAWINGS

Other objects and advantages of the present invention will become apparent during the following discussion in conjunction with the accompanying drawings, which.

DETAILED DESCRIPTION OF THE PREFERRED EMBODIMENTS

Specific embodiments an electrophotographic apparatus according to this invention will hereinafter be discussed.

<Embodiment 1>

Figure 1:
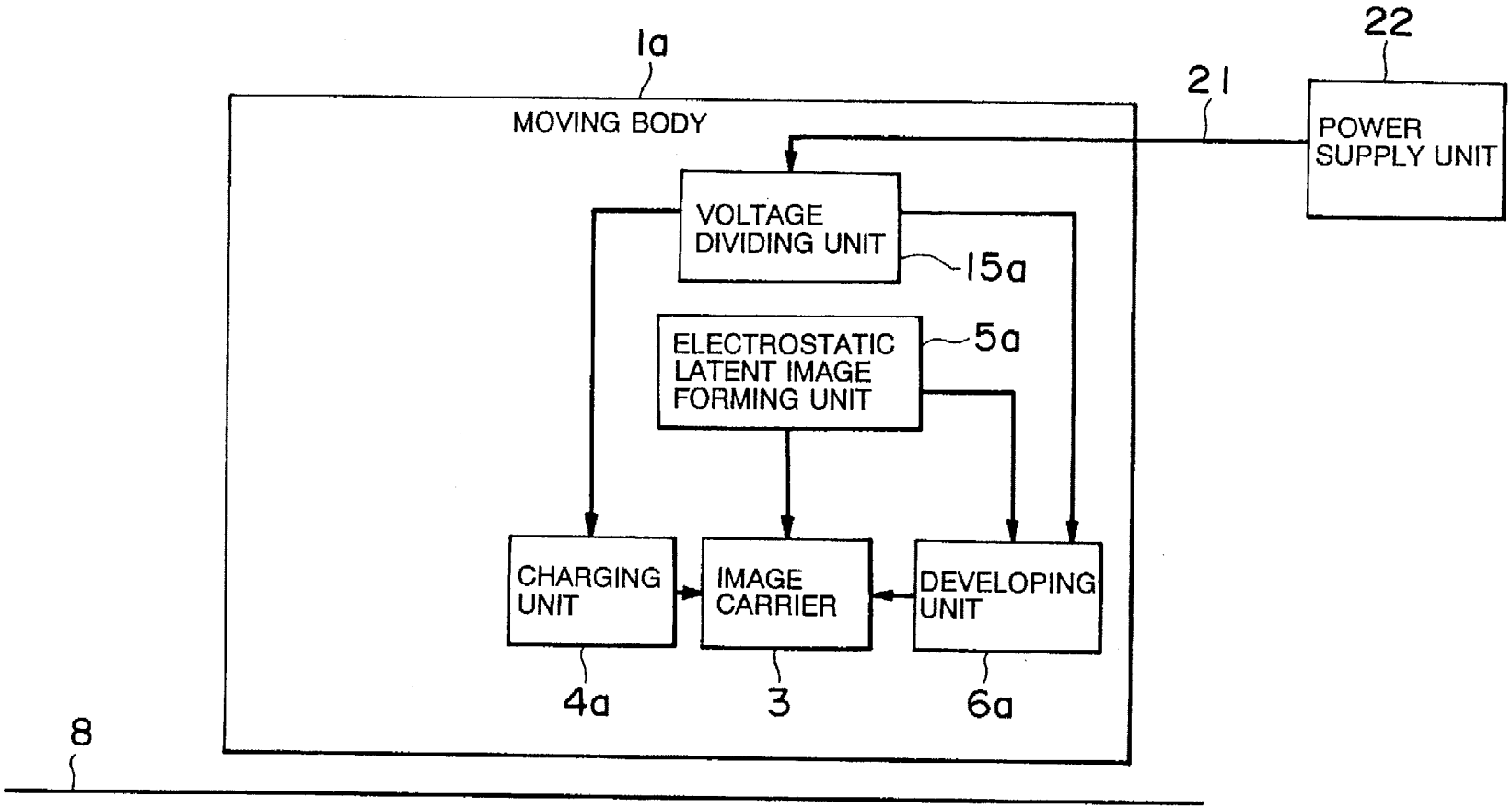
FIG. 1 is a block diagram illustrating a construction of an electrophotographic apparatus in accordance with an embodiment 1 the present invention.

FIG. 1 is a block diagram illustrating a construction of the electrophotographic apparatus in accordance with an embodiment 1 this invention. The electrophotographic apparatus in the embodiment 1 includes a moving body 1*a* and a power supply unit 22 connected via a cable 21 to the moving body 1*a*. The moving body 1*a* has an image carrier 3, a charging unit 4*a*, an electrostatic latent image forming unit 5*a*, a developing unit 6*a* and a voltage dividing unit 15*a*. The moving body moves in reciprocation in directions perpendicular to a feeding direction of a chart 8. The moving body 1*a* is, e.g., a carriage or the like. The image carrier 3 rotates in synchronism with a movement of the moving body 1*a*. The image carrier 3 is, e.g., a photosensitive drum or the like.

The charging unit 4*a* charges the image carrier 3, thereby providing a uniform electric potential to the surface of the image carrier 3. For instance, the charging unit 4*a* may be charging rollers and a charging brush.

The electrostatic latent image forming unit 5*a* forms the electrostatic latent image by irradiating the surface of the image carrier 3 with the light, which surface is uniformly charged by the charging unit 4*a*. The electrostatic latent image forming unit 5*a* is, e.g., an exposure unit or the like. The developing unit 6*a* develops the electrostatic latent image formed on the image carrier 3. The developing unit 6*a* is, e.g., developing rollers or the like.

The voltage dividing unit 15*a* is mounted on the moving body 1*a* and therefore moves in synchronism with the moving body 1*a*. The voltage dividing unit 15*a* divides a predetermined voltage supplied via the cable 21 from the power supply unit 22. The voltage dividing unit 15*a* supplies the divided voltages to the charging unit 4*a* and to the developing unit 6*a*.

According to the thus constructed electrophotographic apparatus, the power supply unit 22 supplies a predetermined voltage via the cable 21 to the voltage dividing unit 15*a* mounted on the moving body 1*a*. The voltage dividing unit 15*a* supplies the charging unit 4*a* and the developing unit 6*a* with the divided voltages into which the predetermined voltage is divided. Accordingly, the power supply unit 22 supplies the respective units of the moving body 1*a* via a small number of cables 21, and, therefore, a leakage between the cables 21 can be reduced.

<Embodiment 2>

Figure 2:
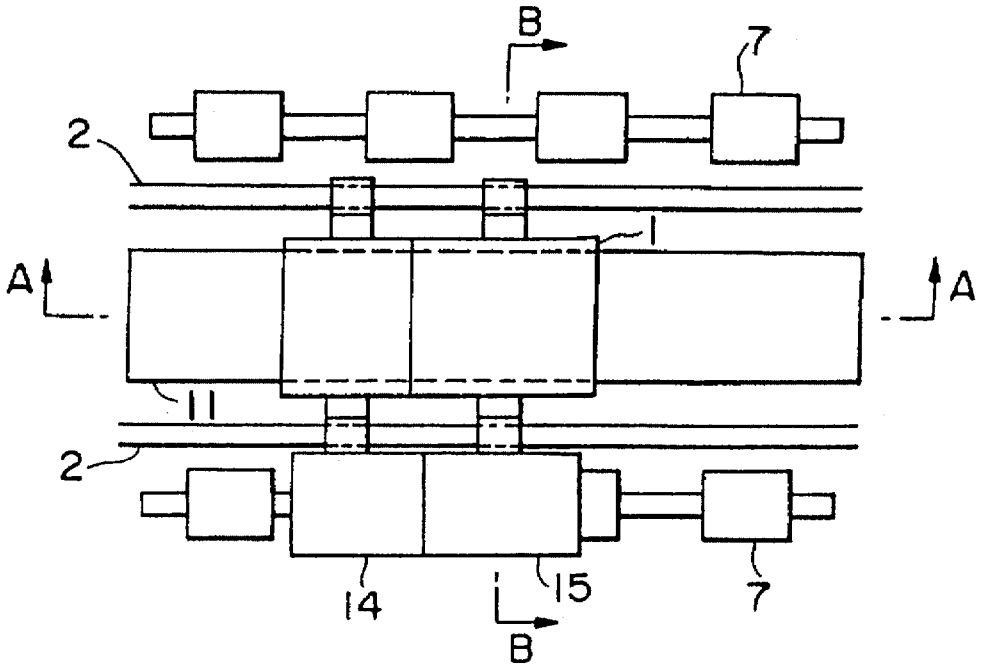
FIG. 2 is a plan view illustrating the electrophotographic apparatus in accordance with an embodiment 2 this invention.
Figure 3:
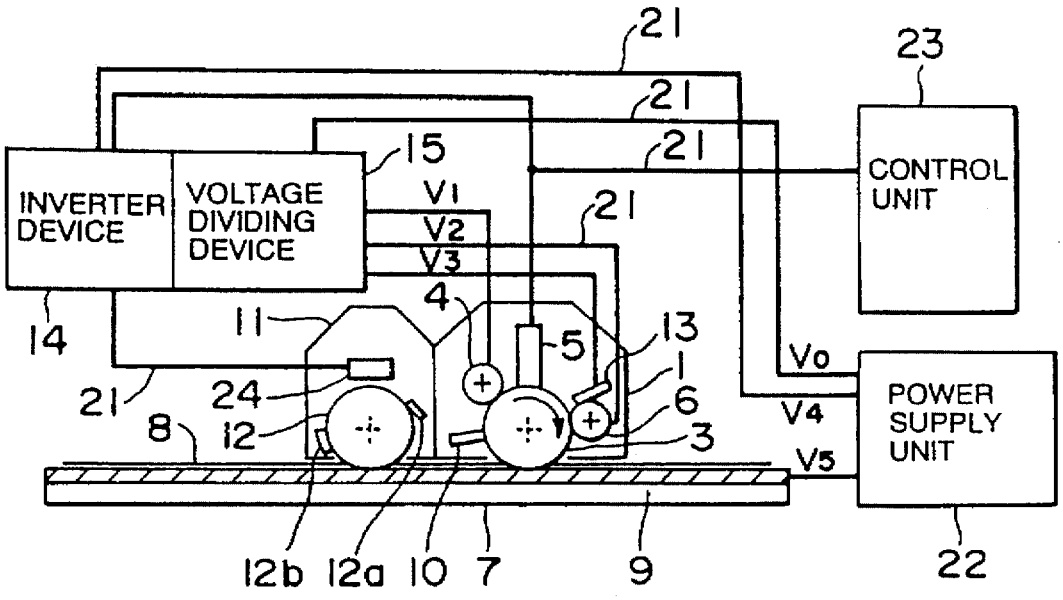
FIG. 3 is a sectional view taken along the line A—A of FIG. 2 in the embodiment 2.
Figure 4:
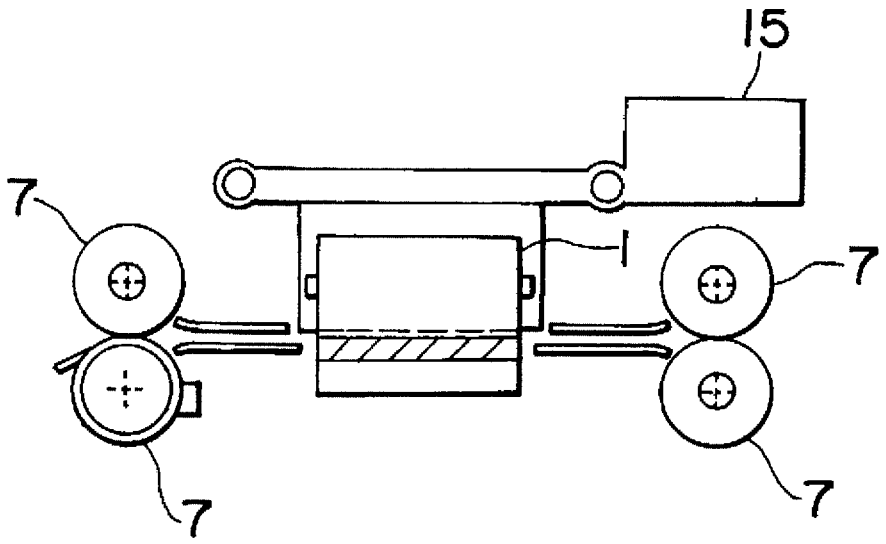
FIG. 4 is a sectional view taken along the line B—B of FIG. 2 in the embodiment 2.

Next, an embodiment 2 the present invention will be described. FIG. 2 is a plan view illustrating the electrophotographic apparatus in accordance with the embodiment 2 the present invention. FIG. 3 is a sectional view taken along the line A—A of FIG. 2 in the embodiment 2. FIG. 4 is a sectional view taken along the line B—B of FIG. 2 in the embodiment 2. The electrophotographic apparatus includes a carriage 1, a fixing unit 11, a power supply unit 22 and a control unit 23. The carriage 1 corresponds to the moving body and moves in reciprocation along shafts 2. The carriage 1 is moved by driving an unillustrated drive motor in the directions perpendicular to the feeding direction of a chart 8. The carriage 1 is mounted with the image carrier 3, a charging unit 4, an exposure unit 5, developing rollers 6, a cleaner 10 and doctor blades 13.

The image carrier 3 rotates at the same peripheral speed as a speed at which the carriage 1 moves. The charging unit 4 corresponds to a charging element and uniformly charges the surface of the image carrier 3. The exposure unit 5 corresponds to an electrostatic latent image forming element and forms the electrostatic latent image by irradiating the surface of the image carrier 3 with the light, which surface is uniformly charged by the charging unit 4.

The developing rollers 6 correspond to a developing element and transform the electrostatic latent image obtained by the exposure unit 5 into a toner image. A transferring unit 9 is disposed in a face-to-face relationship with the image carrier 3, with the chart 8 being sandwiched in therebetween. The transferring unit 9 transfers the toner image formed on the image carrier 3 onto the chart 8.

The cleaner 10 scrapes off the toners remaining on the image carrier 3. The charging unit 4 again charges the surface of the cleaned image carrier 3.

The image carrier 3, the charging unit 4, the exposure unit 5, the developing rollers 6 and the cleaner 10 repeatedly perform the printing process.

Feed rollers 7, after finishing the print to a predetermined width, feed the chart 8 by a predetermined quantity in the feeding direction. The carriage 1 is returned to a predetermined position by an unillustrated drive motor.

The fixing unit 11 corresponding to a fixing element is linked to the carriage 1 and therefore moves in reciprocation along the shafts 2. Hence, the fixing unit 11 moves in synchronism with the carriage 1. The fixing unit 11 has a heating coil 24 and fixing rollers 12. The heating coil 24 heats the fixing rollers. The toner image on the chart 8 is heat-fixed by heating of the fixing rollers 12.

Further, a voltage dividing device 15 corresponding to the voltage dividing element is linked to the carriage 1 and therefore moves in reciprocation along the shafts 2. Accordingly, the voltage dividing device 15 moves in synchronism with the carriage 1. Note that the voltage dividing device 15 may be mounted on the carriage 1. In this case also, the voltage dividing device 15 moves in synchronism with the carriage 1. The power supply unit 22 supplies the voltage dividing device 15 also with a high voltage $V_O$ via a cable 21.

Figure 5:
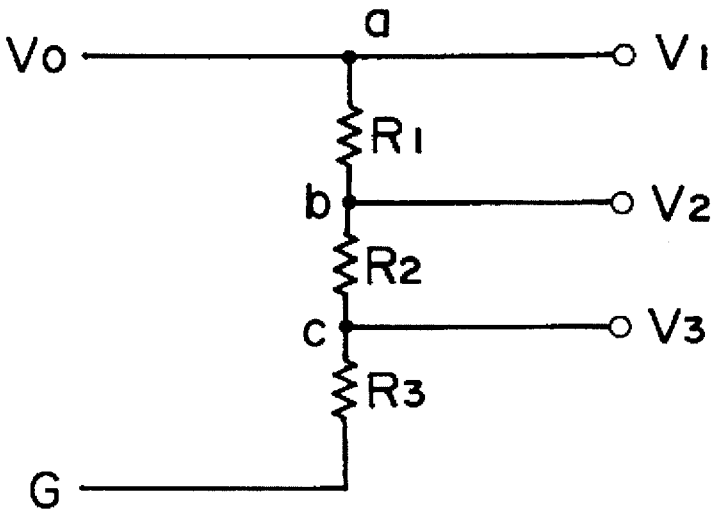
FIG. 5 is a view showing a configuration of a voltage dividing device in the embodiment 2.

FIG. 5 is a view illustrating a configuration of the voltage dividing device in the embodiment 2. Referring to FIG. 5, the voltage dividing device 15 is constructed such that a resistance $R_1$, a resistance $R_2$ and a resistance $R_3$ are connected in series between the high voltage $V_O$ and a Ground G, thereby dividing the high voltage $V_O$ by each resistance. A divided voltage $V_1$ is fetched out of one terminal a of the resistance $R_1$. A divided voltage $V_2$ is fetched out of a connecting point b between the resistance $R_1$ and the resistance $R_2$. A divided voltage V.is taken out of a connecting point c between the resistance $R_2$ and the resistance $R_3$.

In this instance, $V_1$, $V_2$ and $V_3$ are given by the following formula:

$$V_1=V_O$$

$$V_2=(R_2+R_3)\cdot V_O/(R_1+R_2+R_3)$$

$$V_3=R\cdot V_O/(R_1+R_2+R_3)$$

Note that an electric current flowing across the resistance $R_1$ may be quite small, and, hence, values of the resistances $R_1$, $R_2$ and $R_3$ may also be increased.

The divided voltage $V_1$ obtained by the voltage dividing device 15 is supplied via the cable 21 to the charging unit 4. The divided voltage $V_2$ obtained by the voltage dividing device 15 is supplied via the cable 21 to the developing rollers 6.

The divided voltage $V_3$ obtained by the voltage dividing device 15 is supplied via the cable 21 to the doctor blades 13. Note that the divided voltages $V_1$, $V_2$ and $V_3$ are properly set to voltages necessary for the respective units. Further, the transferring unit 9 is supplied with a required voltage $V_5$ from the power supply unit 22 via the cable 21.

An inverter device 14 corresponding to a driving element is linked to the fixing unit 11 and moves in reciprocation along the shafts 2. Accordingly, the inverter device 14 moves in synchronism with the fixing unit 11 and the carriage 1.

The inverter device 14 is supplied with a predetermined drive voltage $V_4$ from the power supply unit 22 via the cable 21. The inverter device 14 flows the electric current to a heating coil 24 provided in the fixing unit 11 via the cable 21. The above control unit 23 controls the voltage diving device 15 and the exposure unit 5 as well.

Figure 6:
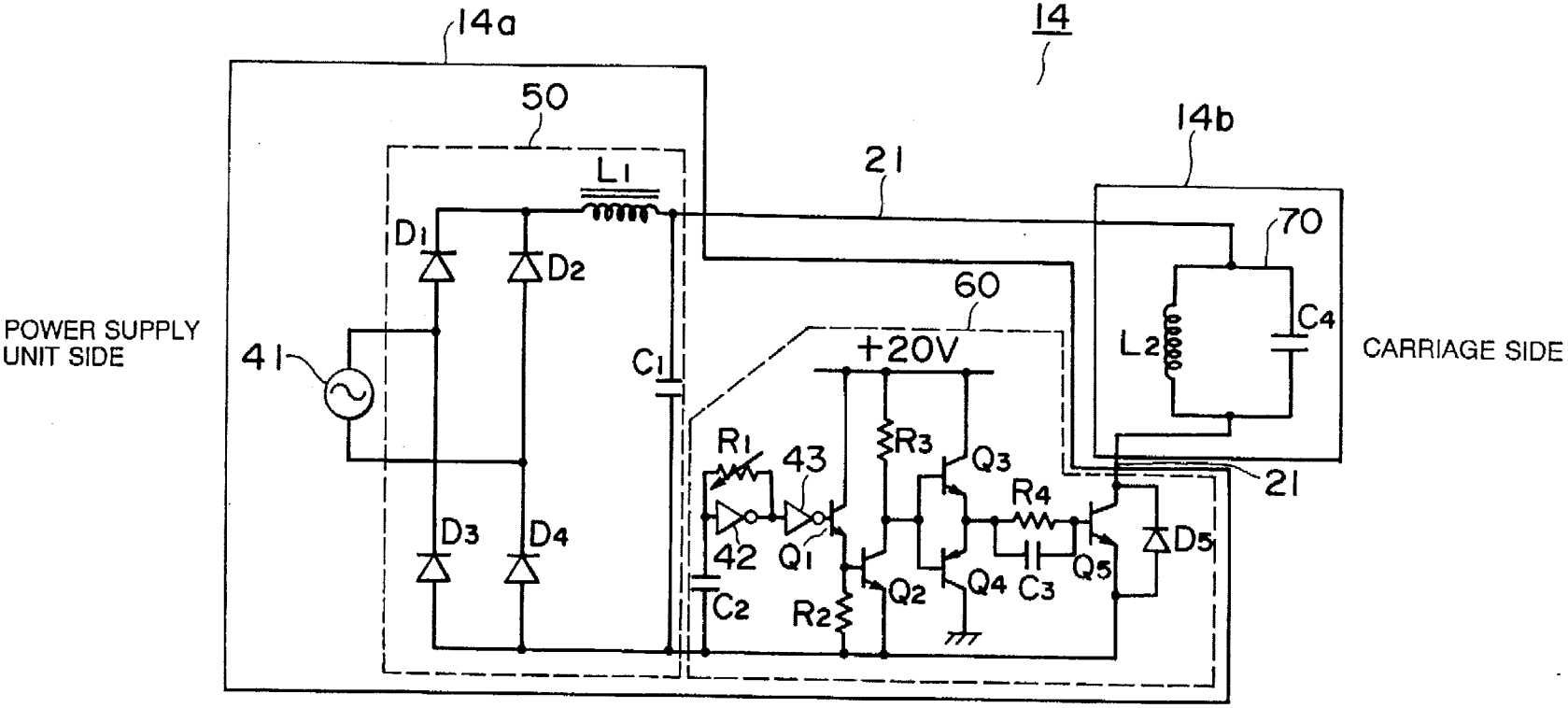
FIG. 6 is a view showing a configuration of an inverter device in the embodiment 2.

FIG. 6 is a view illustrating a configuration of the inverter device in the embodiment 2. The inverter device 14 is intended to drive the fixing unit 11 and constructed of inverters **14*a* and 14*b*. The inverter 14 is composed of an AC power supply 41, a rectifier circuit 50 for rectifying the alternate current and an inverter section 60 for converting DC into AC. The inverter 14*b* is composed of a resonance circuit 70**.

The resonance circuit 70 in the inverter **14*b* is provided on the side of the carriage 1. Note that the resonance circuit 70 may also be provided on the side of the fixing unit 11 instead of being provided on the side of the carriage 1**.

The AC power supply 41, the rectifier circuit 50 and the inverter section 60 within the inverter 14 are provided on the side of the power supply unit 22. Therefore, as shown in FIG. 6, the rectifier circuit 50 is connected via the cable 21 to the resonance circuit 70, while the inverter section 60 is connected via the cable 21 to the resonance circuit 70. The resonance circuit 70, which is connected to the rectifier circuit 50 and to the inverter section 60, thus performs a voltage resonance. A rectifier element corresponds to the rectifier circuit 50, while a resonance element corresponds to the resonance circuit.

Referring again to FIG. 3, the fixing unit 11 includes fixing rollers 12, a thermistor **12*b* and a cleaner 12*a*. The fixing rollers 12 are formed of a magnetic material which is induction-heated by the heating coil 24. The thermistor 12*b* detects a temperature of the fixing rollers 12. The cleaner 12*a* cleans the fixing rollers 12**.

The rectifier circuit 50 is constructed of diodes D1–D4, a choke coil L1 and a smoothing capacitor C1. The diodes D1–D4 are bridge-connected to the AC power supply 41. The inverter section 60 is constructed by including OP amps 42 and 43, transistors Q1–Q5, capacitors C3, a diode D5 and resistors $R_1$–$R_4$.

The resonance circuit 70 is constructed of a coil L2 for effecting the voltage resonance and a capacitor C4 connected in parallel to the coil L2.

<Operation of the Embodiment 2>

Next, the operation of the thus constructed embodiment 2 will be explained. The operation of this embodiment will be discussed referring to the drawings.

First, the voltage dividing device 15 inputs the predetermined voltage $V_O$ via the single cable 21 from the power supply unit 22. Then, the voltage dividing device 15 divides the voltage $V_O$ into the voltages $V_1$, $V_2$ and $V_3$ by the resistances $R_1$, $R_2$ and $R_3$.

Further, the divided voltages $V_1$, $V_2$ and $V_3$ are supplied to the charging unit 4, the exposure unit 5 and the developing rollers 6, which correspond to these voltages.

Next, a series of electrophotographic processes are to be performed. That is, when the image carrier 3 rotates at the same peripheral speed as the moving velocity of the carriage 1, the charging unit 4 uniformly charges the surface of the image carrier 3.

Then, the exposure unit 5 forms an electrostatic latent image. The electrostatic latent image is transformed into a visible toner image by the developing rollers 6.

Further, the toner image formed on the image carrier 3 is transferred onto the chart 8 by the transferring unit 9. The toners remaining on the image carrier 3 are scraped off by the cleaner 10.

In this manner, the image carrier 3, the charging unit 4, the exposure unit 5, the developing rollers 6 and the cleaner 10 repeatedly perform the printing process.

When finishing the print to a predetermined width, the chart 8 is fed by a predetermined quantity by the feeding rollers 7. Further, the carriage 1 is returned to a predetermined position by the unillustrated motor.

At this time, the voltage dividing device 15 moves in synchronism with the carriage 1. Hereupon, the single cable 21 extending from the power supply unit 22 moves with a movement of the voltage dividing device 15. In this case, only one cable is provided, and, consequently, a leakage between the cables 21 disappears.

Moreover, the fixing unit 11 moves in synchronism with the carriage 1. The heating coil 24 heats the fixing rollers 12. Then, the toner image on the chart 8 is heat-fixed by the heated fixing rollers 12.

In this instance, the resonance circuit 70 is provided in the inverter 14*b* on the side of the carriage 1. In the inverter 14*a* provided on the side of the power supply unit 22, the alternate current coming from the AC power supply 41 is rectified by the rectifier circuit 50, while the direct current is converted into the alternate current by the inverter section 60.

Figure 7:
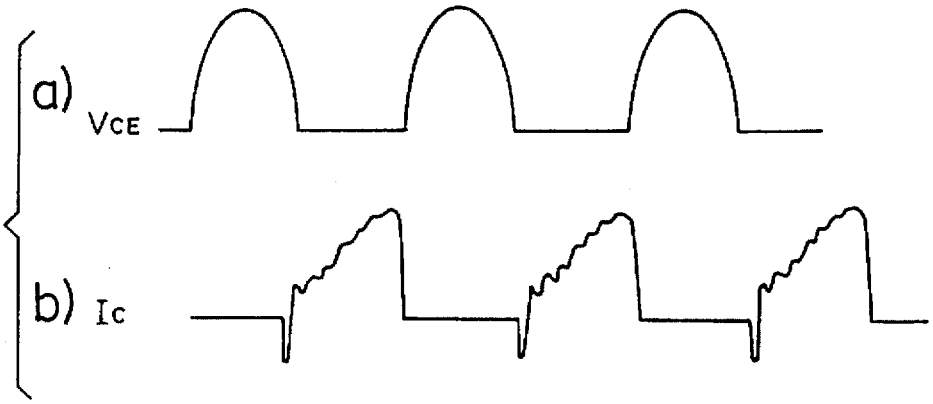
FIGS. 7 (*a*) and 7 (*b*) are views showing waveforms in a resonating circuit within an inverter device in the embodiment 2.

Then, the resonance circuit 70 is supplied with the rectified output and the AC output via the cable 21. The resonance circuit 70 effects the voltage resonance, thereby switching the electric current at a high speed. FIGS. 7(*b*) and 7(*a*) illustrate waveforms of an electric current Ic flowing to a collector of the transistor Q5 and of a voltage Vce between the collector and an emitter, respectively.

That is, the resonance circuit 70 is provided in the inverter 14*b* on the side of the carriage 1, and, hence, there decreases such a possibility that the electric current having a high frequency which has been switched by the resonance circuit 70 flows in between the carriage 1 and the power supply unit 22 via the cable 21. Because of this, a wiring impedance is reduced by shortening a length of the cable 21 through which the large current flows. Therefore, a loss in the electric current is decreased, and, besides, the noises can be reduced.

Further, when the loss in the electric current is decreased, the fixing rollers 12 are heated by a large output. It is therefore possible to reduce both a fixing time and a printing time.

Figure 8:
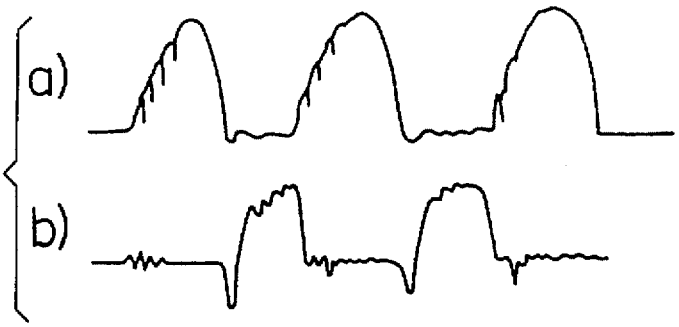
FIGS. 8(*a*) and 8 (*b*) are views showing waveforms in a resonating circuit within conventional inverter device.

Incidentally, FIGS. 8(*a*) and 8(*b*) show waveforms when the carriage 1 is not provided with the resonance circuit 70. In this case, the resonance circuit 70 is provided on the side of the power supply unit 22. A high switching current obtained in the resonance circuit 70 is supplied via the cable 21 to the fixing unit 12. Hence, a voltage taking, as shown in FIGS. 8(*a*) and 8(*b*) a spike waveform is generated by the wiring impedance. This results in a destruction of the elements and an occurrence of noises. Further, the resonant waveform is disturbed, and consequently the efficiency drops down. In the worst case, the electric current having the high frequency does not oscillate.

Note that the inverter 14*a* is disposed on the side of the power supply unit 22, while the inverter 14*b* is disposed on the side of the carriage 1 in the embodiment 2. For instance, however, both the inverter 14*a* and the inverter 14*b* may also be provided on the side of the carriage 1. In this case also, a larger amount of advantages than in the embodiment 2 are obtainable.

<Embodiment 3>

Figure 9:
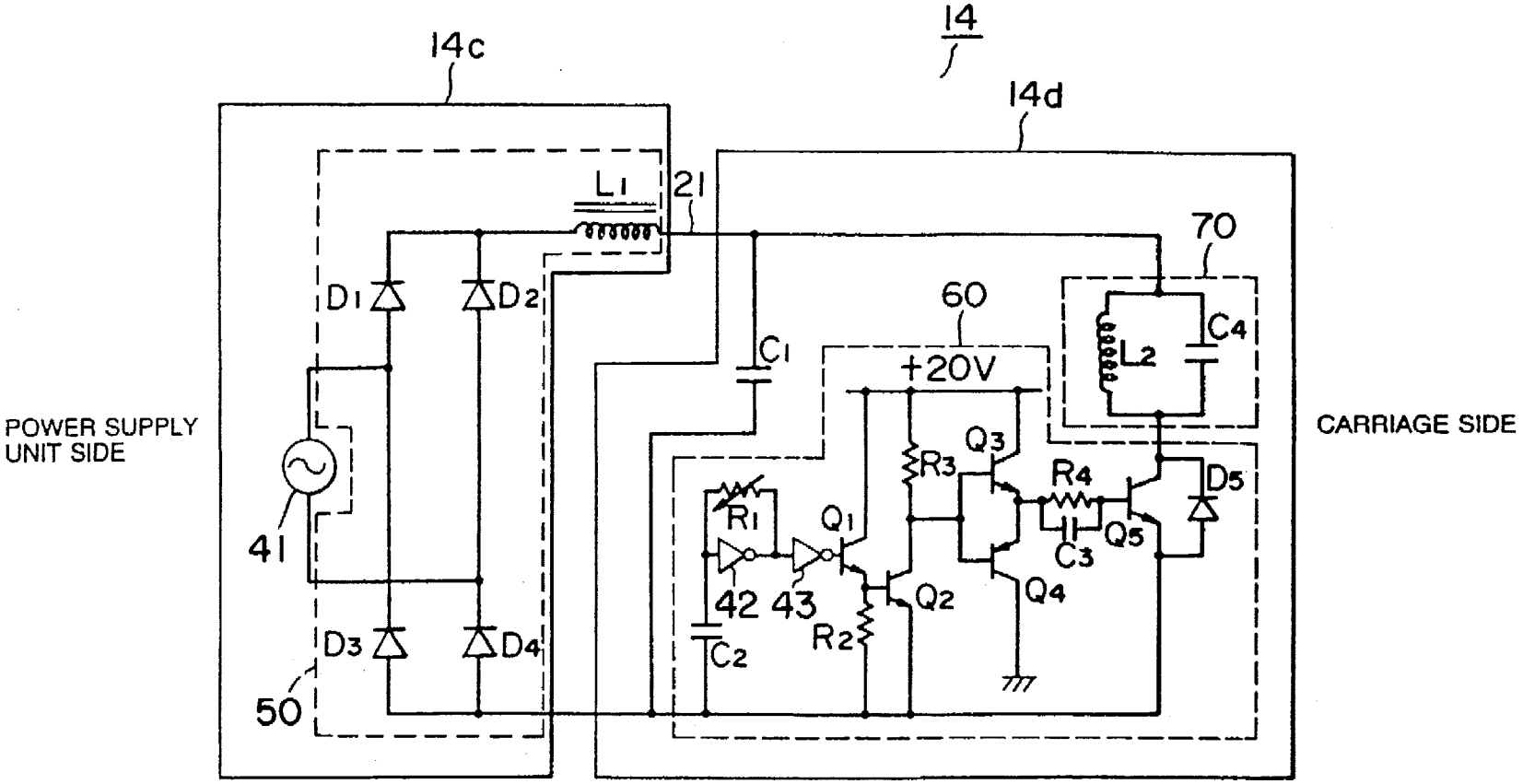
FIG. 9 view showing a configuration of the inverter device an embodiment 3 this invention.

Next, an embodiment 3 of the present invention will be discussed. FIG. 9 is a block diagram illustrating an inverter device in accordance with the embodiment 3 of this invention. A construction of the inverter device in the embodiment 3 is basically the same as the construction thereof in the embodiment 2. The inverter device 14 is constructed of an inverter 14*c* and an inverter 14*d*. The inverter 14*c* is composed of the AC power supply 41 and the rectifier circuit 50. The AC power supply 41 and the rectifier circuit 50 are provided on the side of the power supply unit 22 (shown in FIG. 3, for example).

The inverter 14*d* is composed of the inverter section 60 and the resonance circuit 70. The inverter section 60 and the resonance circuit 70 are provided on the side of the carriage 1. As illustrated in FIG. 9, the rectifier circuit 50 is connected via the cable 21 to the resonance circuit 70. Other configurations are the same as those in the embodiment 2. An explanation will be given, wherein the same units are marked with the like symbols.

<Operation of the Embodiment 3>

Herein, the operation of the voltage dividing device 15 is the same as that in the embodiment 2, and, therefore, its operation will be omitted.

Next, the operation of the inverter device 14 will be explained. To start with, the resonance circuit 70 and the inverter section 60 within the inverter device 14 are provided on the side of the carriage 1. Herein, in the inverter 14*c* provided on the side of the power supply unit 22, the alternate current coming from the AC power supply 41 is rectified by the rectifier circuit 50, and a rectified output thereof is supplied via the cable 21 to the resonance circuit 70 in the carriage 1.

On the other hand, in the inverter 14*d* provided on the side of the carriage 1, the direct current is converted into the alternate current by the inverter section 60. Then, the resonance circuit 70 performs the voltage resonance with the rectified output and the AC output, thereby switching the electric current at a high speed.

FIGS. 7(*b*) and 7(*a*) illustrate waveforms of the electric current Ic flowing across the collector of the transistor Q5 and of the collector-emitter voltage Vce, respectively.

That is, the resonance circuit 70 and the inverter section 60 are provided on the side of the carriage 1, and, hence, a possibility decreases that the electric current having a high frequency which has been switched by the resonance circuit 70 flows in between the carriage 1 and the power supply unit 22 via the cable 21. Because of this, the wiring impedance is reduced by shortening a length of the cable 21 through which the large current flows. Therefore, the loss in the electric current is decreased, and, besides, the noises can be reduced.

Further, when the loss in the electric current is decreased, the fixing rollers 12 are heated by the large output. It is therefore possible to reduce both the fixing time and the printing time.

In accordance with the embodiment 3, the DC-to-AC conversion is performed within the carriage 1, and hence the advantages are greater than in the embodiment 2.

Note that the voltage dividing device 15 may be mounted on the carriage 1. Further, the resonance circuit 70 and the inverter device 14 may be provided in the fixing unit 11.

<Embodiment 4>

Figure 10:
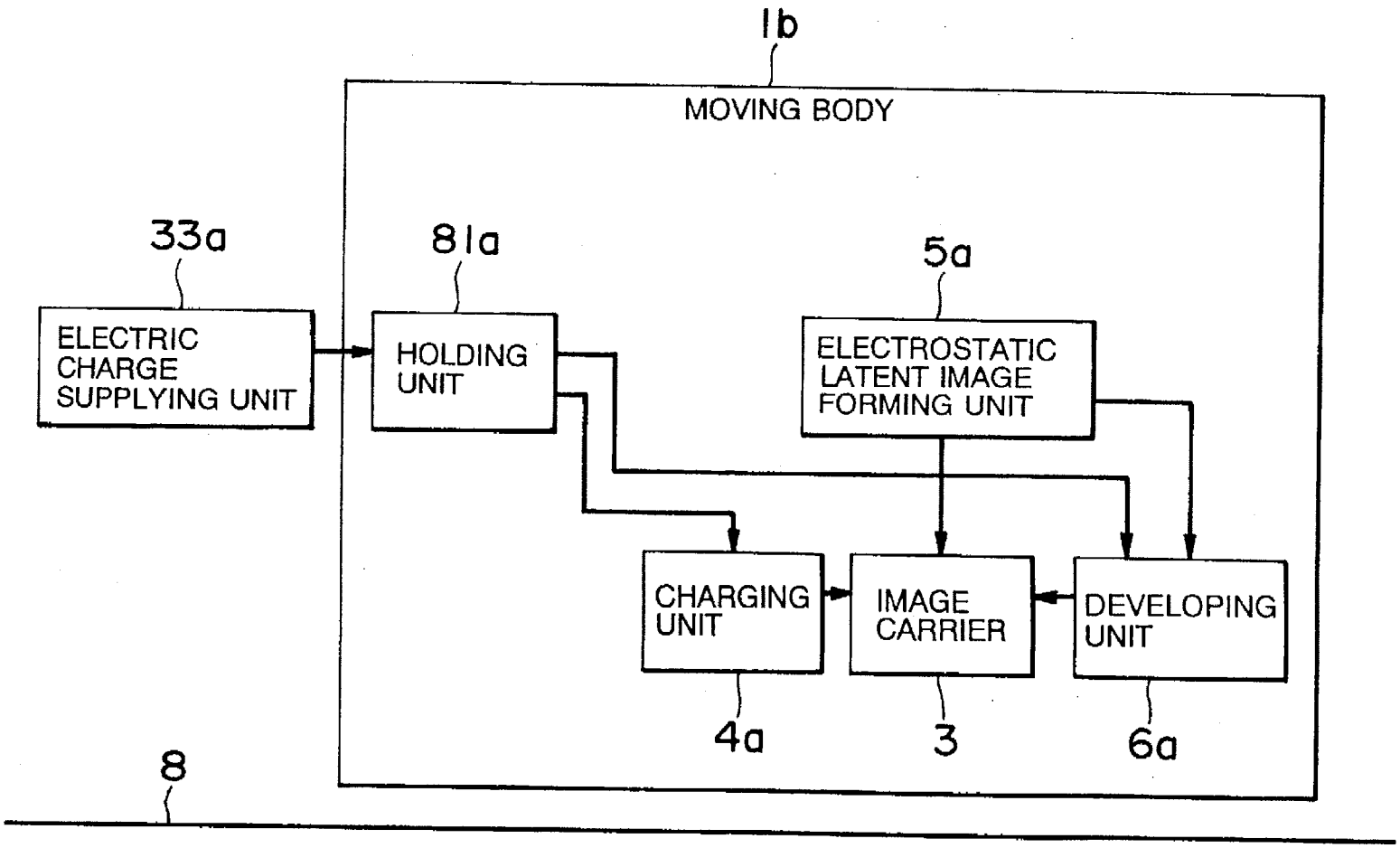
FIG. 10 block diagram illustrating a construction of the electrophotographic apparatus in accordance with an embodiment 4 this invention.

Next, an embodiment 4 of this invention will be discussed. FIG. 10 is a block diagram illustrating a construction of the electrophotographic apparatus in accordance with the embodiment 4 of this invention. The electrophotographic apparatus in the embodiment 4 includes a moving body 1*b*, an electric charge supplying unit 33*a* connected to the moving body 1*b* and the chart 8. The moving body 1*b* has the image carrier 3, the charging unit 4*a* and the electrostatic latent image forming unit 5*a*. The moving body 1*b* is equipped with the developing unit 6*a*, and a holding unit 81*a*.

The moving body 1*b* moves in reciprocation in the directions perpendicular to the feeding direction of the chart 8. The image carrier 3 rotates in synchronism with the movement of the moving body 1*b*. The charging unit 4*a* charges the image carrier 3, thereby applying an uniform electric potential to the surface of the image carrier 3. The electrostatic latent image forming unit 5*a* irradiates the uniformly charged surface of the image carrier 3 with the light, thereby forming an electrostatic latent image.

The developing unit 6*a* develops the electrostatic latent image formed on the image carrier 3. The electric charge supplying unit 33*a* supplies the electric charges to the holding unit 81*a*. The holding unit 81a, when the moving body 1*b* is in a start-of-print position, holds the electric charges supplied from the electric charge supplying unit 33*a*. The holding unit 81*a*, when the moving body 1*b* is in an execution-of-print position, applies the held electric charges to the developing unit 6*a* and the charging unit 4*a*.

In the thus constructed electrophotographic apparatus, first, the moving body 1*b* moves in the direction perpendicular to the feeding direction of the chart 8 but stops in the start-of-print position. Hereupon, the holding unit 81*a*, when the moving body 1*b* is in the start-of-print position, holds the electric charges supplied from the electric charge supplying unit 33*a*.

Next, the moving body 1b moves from the start-of-print position to the execution-of-print position. Hereupon, the holding unit 81*a*, when the moving body 1*b* is in the execution-of-print position, applies the held electric charges to the developing unit 6*a* and the charging unit 4*a* as well.

Accordingly, a bias voltage applied to the developing unit 6*a* and the charging unit 4*a*during the print can be kept at a fixed voltage. Further, when the moving body 1*b* moves to the start-of-print position, the holding unit 81*a* is supplied with the electric charges from the electric charge supplying unit 33*a*. Hence, there is eliminated the necessity for the cable 21 led from the power supply unit 22 which has been explained in the embodiment 2. Consequently, the leakage and the electric shock disappears.

<Embodiment 5>

Figure 11:
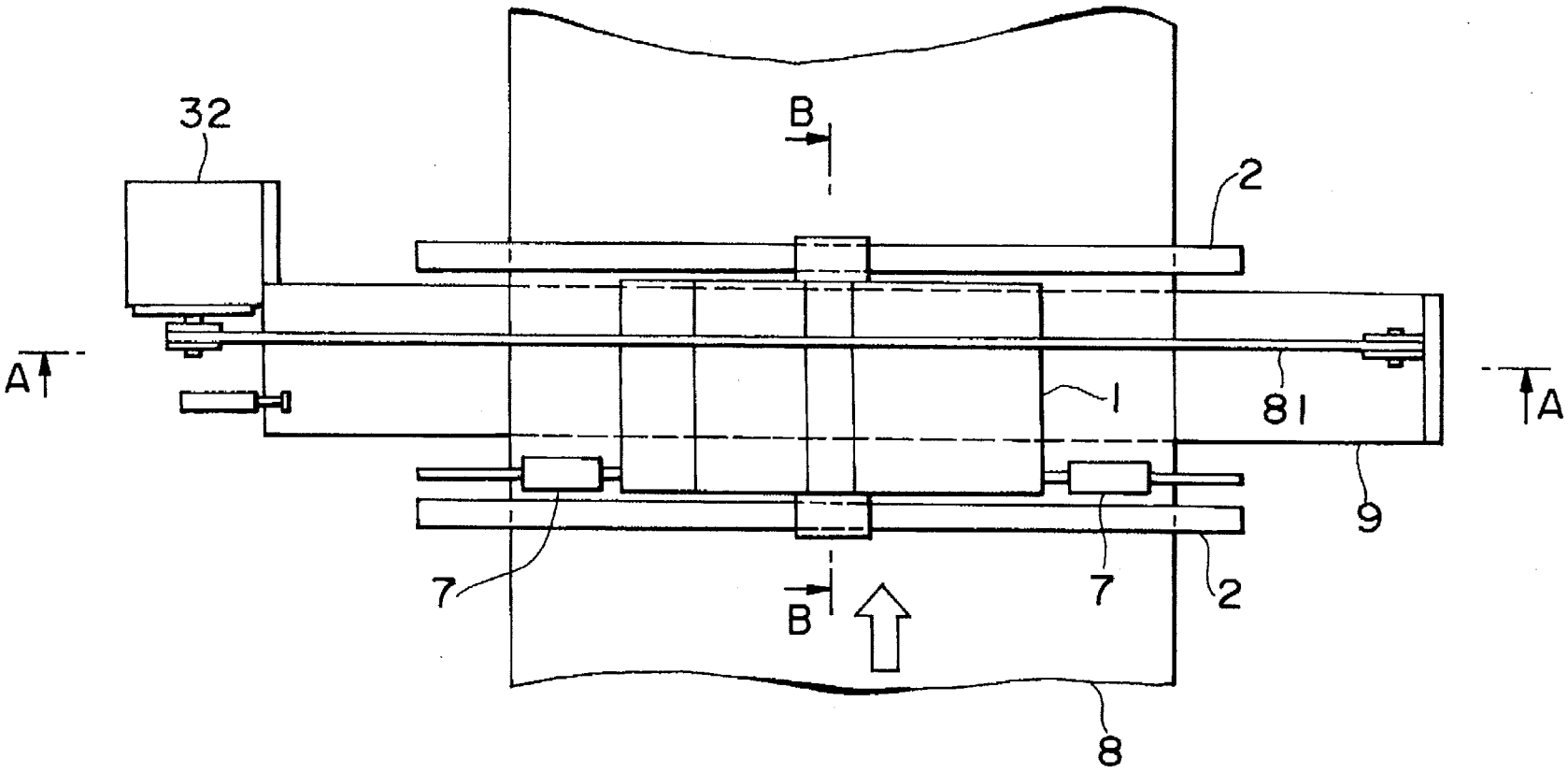
FIG. 11 is a plan view showing the electrophotographic apparatus in accordance with an embodiment 5 of this invention.

Next, an embodiment 5 of this invention will be discussed. FIG. 11 is a plan view illustrating the electrophotographic apparatus in the embodiment 5 of the present invention. The electrophotographic apparatus comprises the carriage 1, a drive motor 32 and feed rollers 7.

As depicted in FIG. 11, the carriage 1 is so attached to the shafts 2 as to be capable of oscillations. The carriage 1 moves above the surface of the chart 8 in the directions perpendicular to the feeding direction of the chart 8 while being guided by the shafts 2. The drive motor 32 causes the carriage 1 to move in the feeding direction with the aid of a belt 81. The feed rollers 7 feed the chart 8 in the chart feeding direction.

Figure 12:
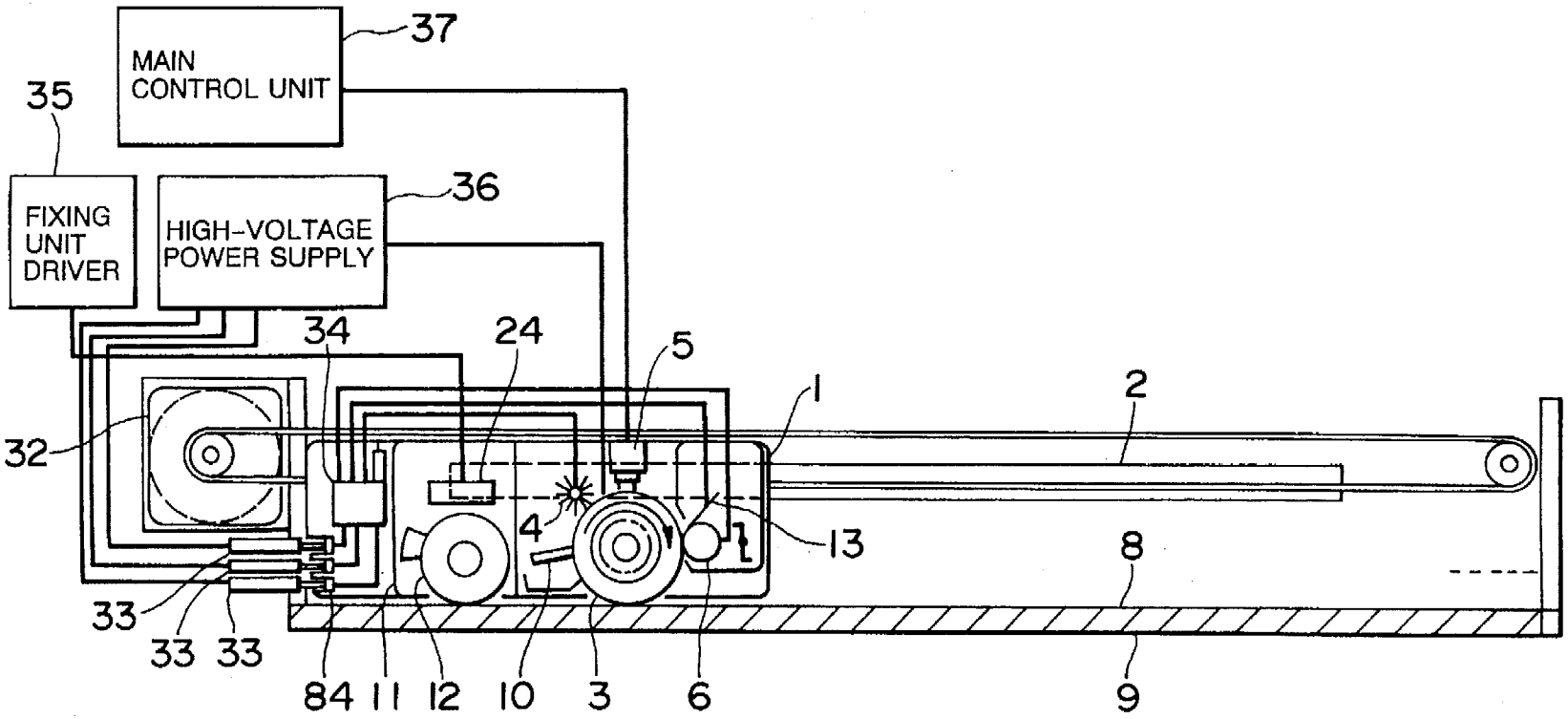
FIG. 12 is a sectional view taken along the line A—A in a start-of-print position of the electrophotographic apparatus in accordance with the embodiment 5.
Figure 13:
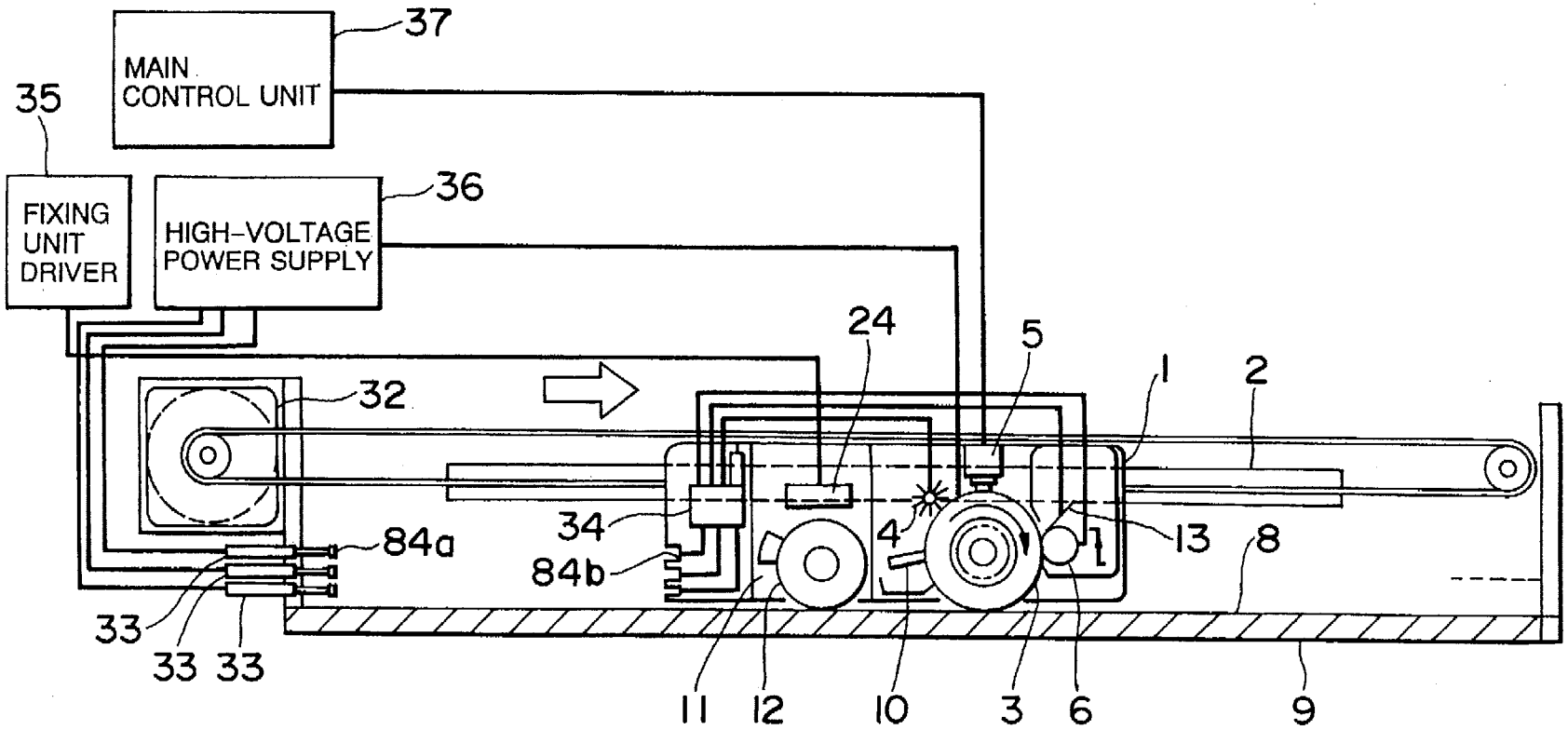
FIG. 13 is a sectional view taken along the line A—A in an execution-of-print position of the electrophotographic apparatus in accordance with the embodiment 5.

FIG. 12 is a sectional view taken along the line A—A in the start-of-print position in the embodiment 3. FIG. 13 is a sectional view taken along the line A—A in the execution-of-print position in the embodiment 3. Referring to FIG. 12, the carriage 1 has the image carrier 3, the charging unit 4, the exposure unit 5 and the developing rollers 6. The image carrier 3 rotates at the same peripheral speed as the moving velocity of the carriage 1. The charging unit 4 uniformly charges the surface of the image carrier 3. The exposure unit 5 forms the electrostatic latent image by irradiating the surface of the image carrier 3 with the light, which surface is uniformly charged by the charging unit 4. The developing rollers transform the electrostatic latent image formed by the exposure unit 5 into a visible toner image in the form of a toner image.

The transferring unit 9 is disposed in a face-to-face relationship with the image carrier 3, with the chart 8 being sandwiched in therebetween. The transferring unit 9 transfers the toner image formed on the image carrier 3 onto the chart 8. The cleaner 10 scrapes off the toners remaining on the image carrier 3. The charging unit 4 again charges the surface of the cleaned image carrier 3. The same print process as the above-mentioned is repeatedly performed.

The electrophotographic apparatus further includes the fixing unit 11, a main control unit 37, a fixing unit driver 35, a high-voltage power supply 36, an electric charge supplying device 33 and an electric charge accumulating unit 34. The fixing unit 11 moves in synchronism with the carriage 1 and heat-fixes the toner image existing on the chart 8.

The feed rollers 7, when finishing the print to a predetermined width, feed the chart by a predetermined quantity. The main control unit 37 applies a high voltage to the exposure unit 5. The fixing unit driver 35 flows the electric current to a heating coil 24 provided within the fixing unit 11.

The high-voltage power supply 36 applies a high voltage to the image carrier 3 and, at the same time, applies the high voltages to the three electric charge supplying devices 33. Each electric charge supplying device 33, on receiving the applied high voltage, supplies an electric charge to the electric charge accumulating unit 34. An electric charge supplying element corresponds to the electric charge supplying device 33.

Figure 14:
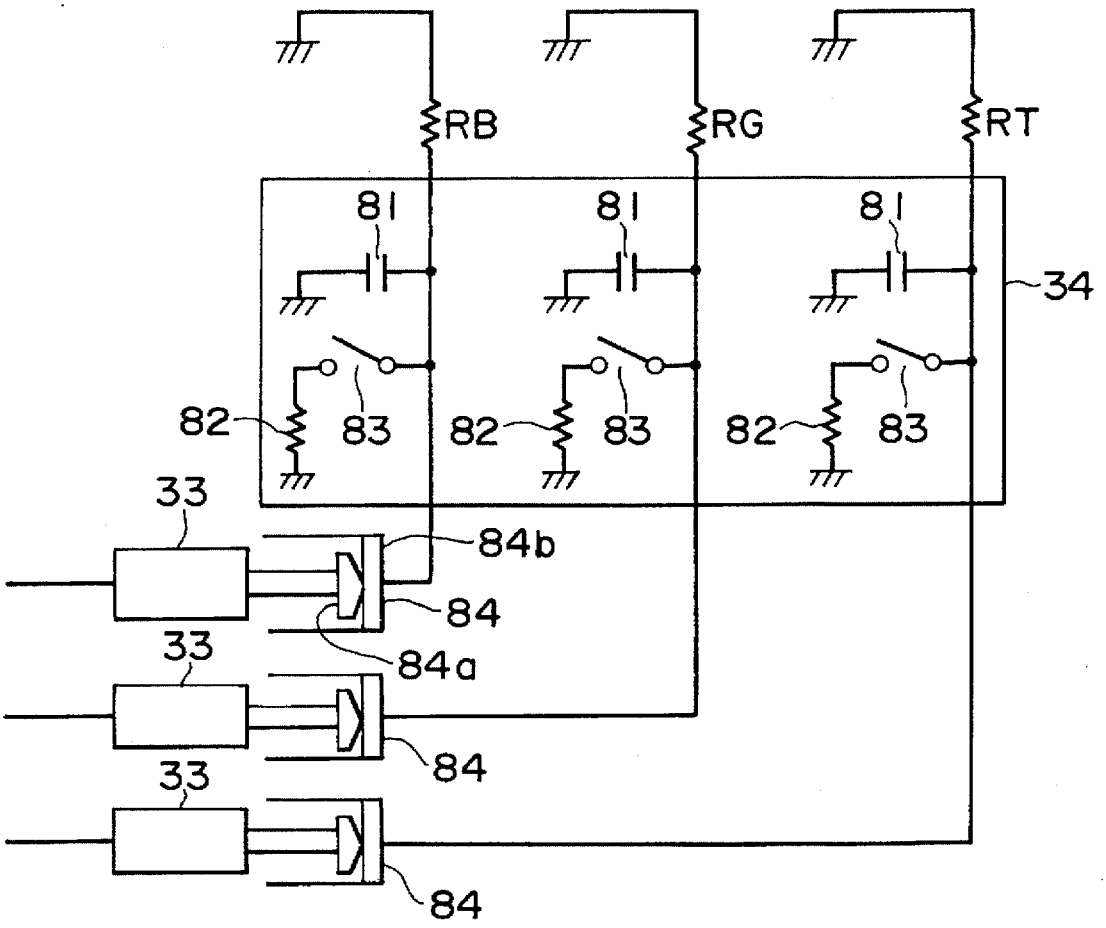
FIG. 14 is a view showing a configuration of an electric charge accumulating unit in the embodiment 5.

FIG. 14 is a view illustrating a configuration of the electric charge accumulating unit 34 in the embodiment 5. Each of the electric charge supplying devices 33 is connected via each switch 84 to the electric charge accumulating unit 34. Each switch 84 is composed of a fixed part 84*a*and a movable part 84*b* moving in synchronism with the carriage 1. As illustrated in FIG. 12, when the carriage 1 is in the start-of-print position, the movable part 84*b* contacts the fixed part 84*a*. As shown in FIG. 13, when the carriage 1 is in the execution-of-print position, the movable part 84*b* separates from the fixed part 84*a*.

The electric charge accumulating unit 34 includes a capacitor 81, a resistance 82 and a switch 83 for every electric charge supplying device 33. Each capacitor 81 accumulates the electric charge supplied from the electric charge supplying device 33 through the switch 84. One terminal of the resistance 82 is grounded, while the other terminal thereof is connected to one terminal of the switch 83. The other terminal of the switch 83 is connected to the movable part 84*b*. The doctor blade 13 is supplied with a voltage relative to the electric charge accumulated in the first capacitor 81. The doctor blade 13 has a resistance PB.

The developing roller 6 is supplied with a voltage relative to the electric charge accumulated in the second capacitor 81. The developing roller 6 has a resistance RG. The charging unit 4 is supplied with a voltage relative to the electric charge accumulated in the third capacitor 81. The charging unit 4 has a resistance RT.

The developing roller 6 and the charging unit 4 are formed of, e.g., semiconductor rubbers of 0.5 MΩ–50 MΩ. Further, the image carrier 3 itself admits a flow of only a trace of current and is therefore substantially approximate to an insulator. For this reason, a trace of electric charges of the capacitors 81 flow out. The outflow of the electric charges is on the order of, e.g., 1 μA or under at a normal temperature.

Each capacitor 81, when the carriage 1 is in the start-of-print position, accumulates the electric charge supplied from the electric charge supplying device 33. Each capacitor 81, when the carriage 1 is in the execution-of-print position, supplies the accumulated electric charges to the developing rollers 6, the charging unit 4 and the doctor blades 13.

The drive motor 32 returns the carriage 1 to the start-of-print position. In this start-of-print position, after the capacitor 81 has been charged with the electricity, the print to the next width is carried out.

<Operation of the Embodiment 5>

The operation of the embodiment 5 will now be explained. First, the carriage 1 reaches to the start-of-print position shown in FIG. 12 with the aid of a rotating force of the drive motor 32. Hereupon, the movable part 84*b* of the switch 84 contacts the fixed part 84*a* thereof. At this time, the electric charge supplying device 33, on receiving the a high voltage from the high-voltage power supply 36, supplies the electric charge accumulating unit 34 with the electric charge relative to this high voltage. With the high voltages, the capacitors 81 within the electric charge accumulating unit 34 gradually accumulate the electric charges.

Then, after a predetermined time has elapsed, the electric charges are sufficiently accumulated in the capacitors 81. The carriage 1 again moves in the direction perpendicular to the feeding direction of the chart 8 in order to effect the print.

Hereupon, the movable part 84*b* of the switch 84 separates from the fixed part 84*a* thereof. That is, the electric charge accumulating unit 34 is separated from the electric charge supplying device 33. Then, the high voltages given by the respective capacitors 81 are applied to the charging unit 4, the developing rollers and the doctor blades 13. Each of the resistances RT, RG and PB of the charging unit 4, the developing roller 6 and the doctor blade 13 has a high resistance value. Further, only the trace of current flows through the image carrier 3 itself. For this reason, the trace of electric charges of the capacitors 81 flow out. Accordingly, the bias electric potential can be kept substantially at a fixed level during the print.

Further, the high voltages given by the capacitors 81 are applied to the respective units by use of the electric charge supplying devices 33 and the electric charge accumulating unit 34. Consequently, there is eliminated the necessity for the high-voltage cable led from the power supply unit to each unit within the carriage 1, thereby preventing the leakage and the electric shock as well.

Further, the switch 83 operates through the resistance 82 and the switch 83 which are provided in the electric charge accumulating unit 34. Then, the electric charge in the capacitor 81 is discharged through the resistance 82. With this operation, the carriage 1 has no residual electric charge, and, therefore, the electric shock can be prevented, resulting in an enhancement in terms of safety.

<Embodiment 6>

Figure 15:
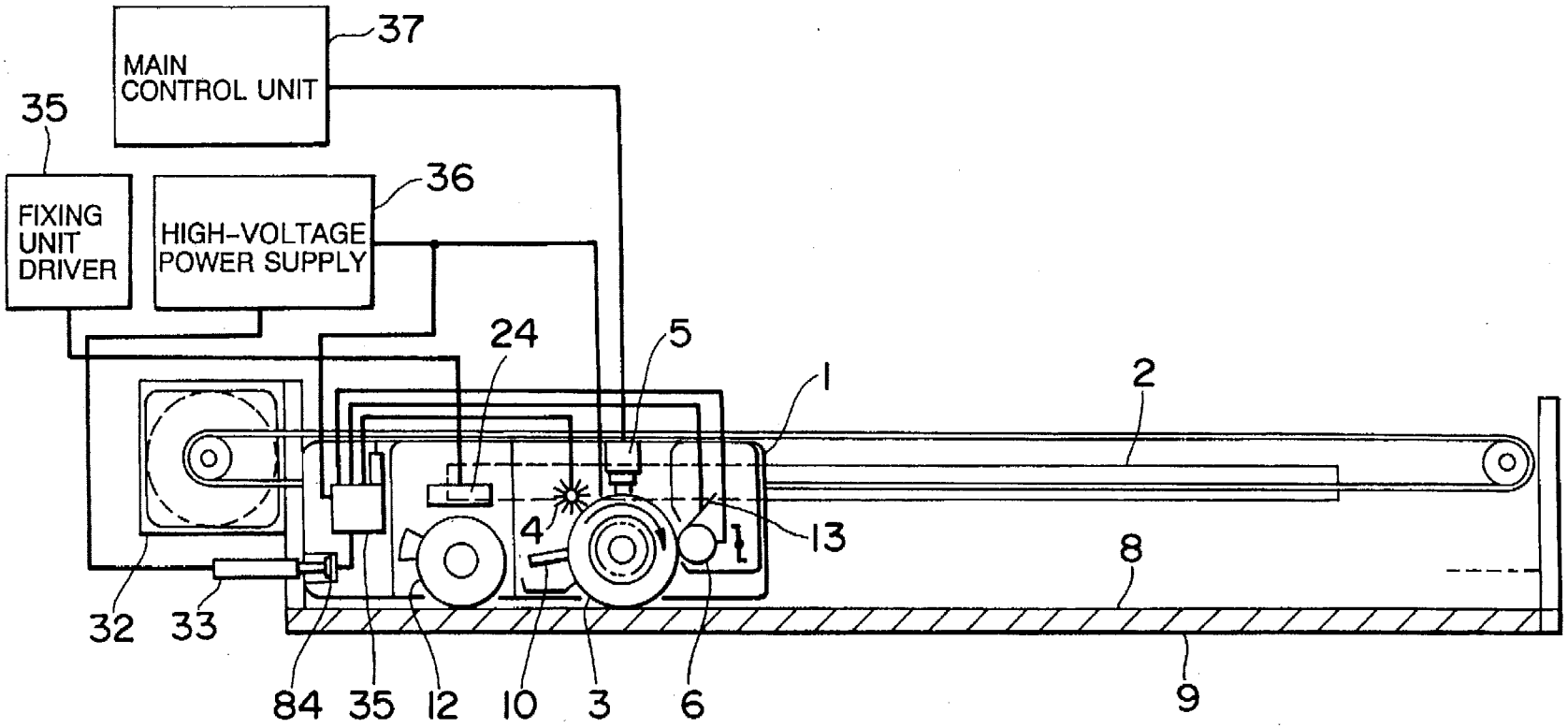
FIG. 15 is a sectional view taken along the line A—A in the start-of-print position of the electrophotographic apparatus in accordance with an embodiment 6 of this invention.
Figure 16:
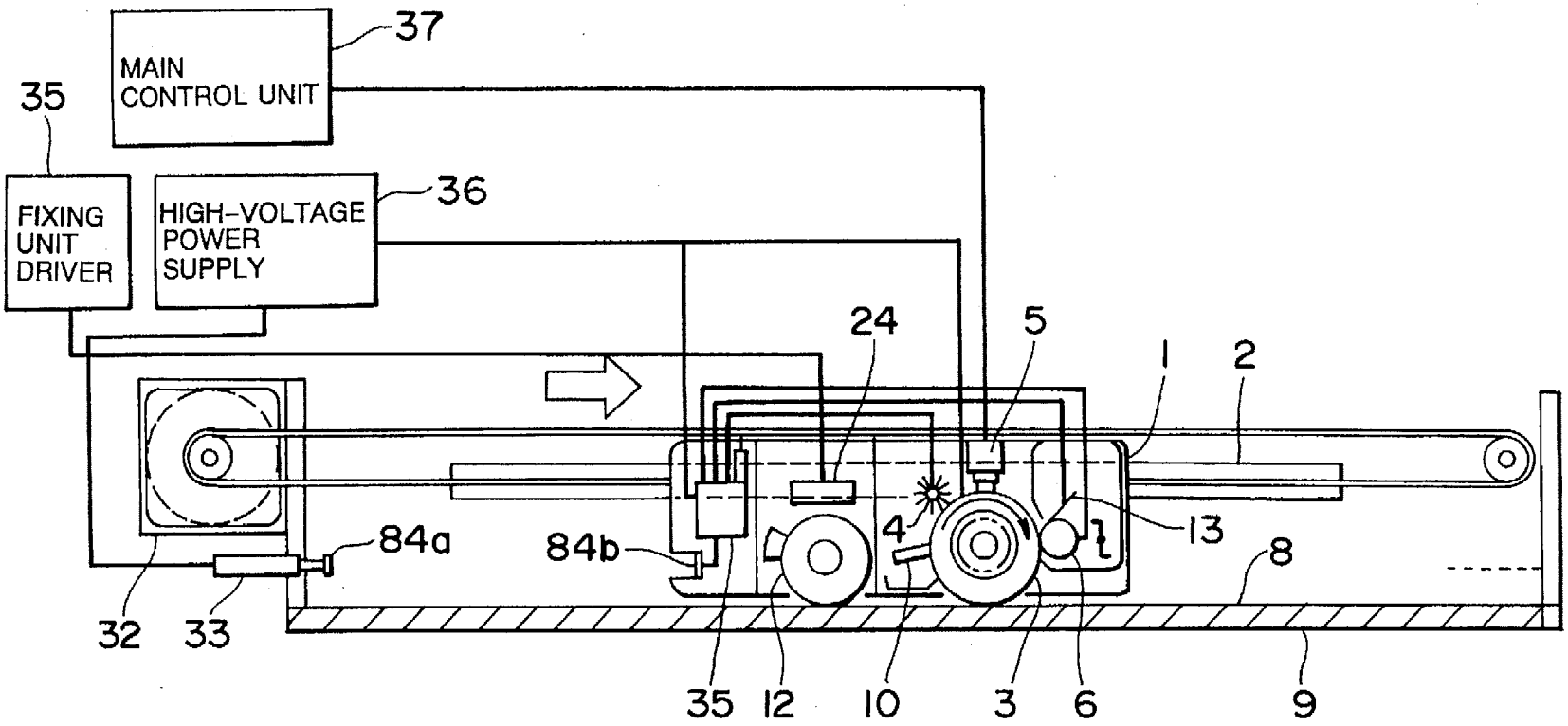
FIG. 16 is a sectional view taken along the line A—A in the execution-of-print position in accordance with the embodiment 6.

FIG. 15 is a sectional view taken along the line A—A in the start-of-print position in the embodiment 6. FIG. 16 is a sectional view taken along the line A—A in the execution-of-print position in the embodiment 6. Referring to FIG. 15, the high-voltage power supply 36 applies the high voltage to the image carrier 3 and, at the same time, applies the high voltage to one electric charge supplying device 33. The electric charge supplying device 33 supplies the electric charge accumulating unit 38 with the electric charge relative to the applied high voltage.

Figure 17:
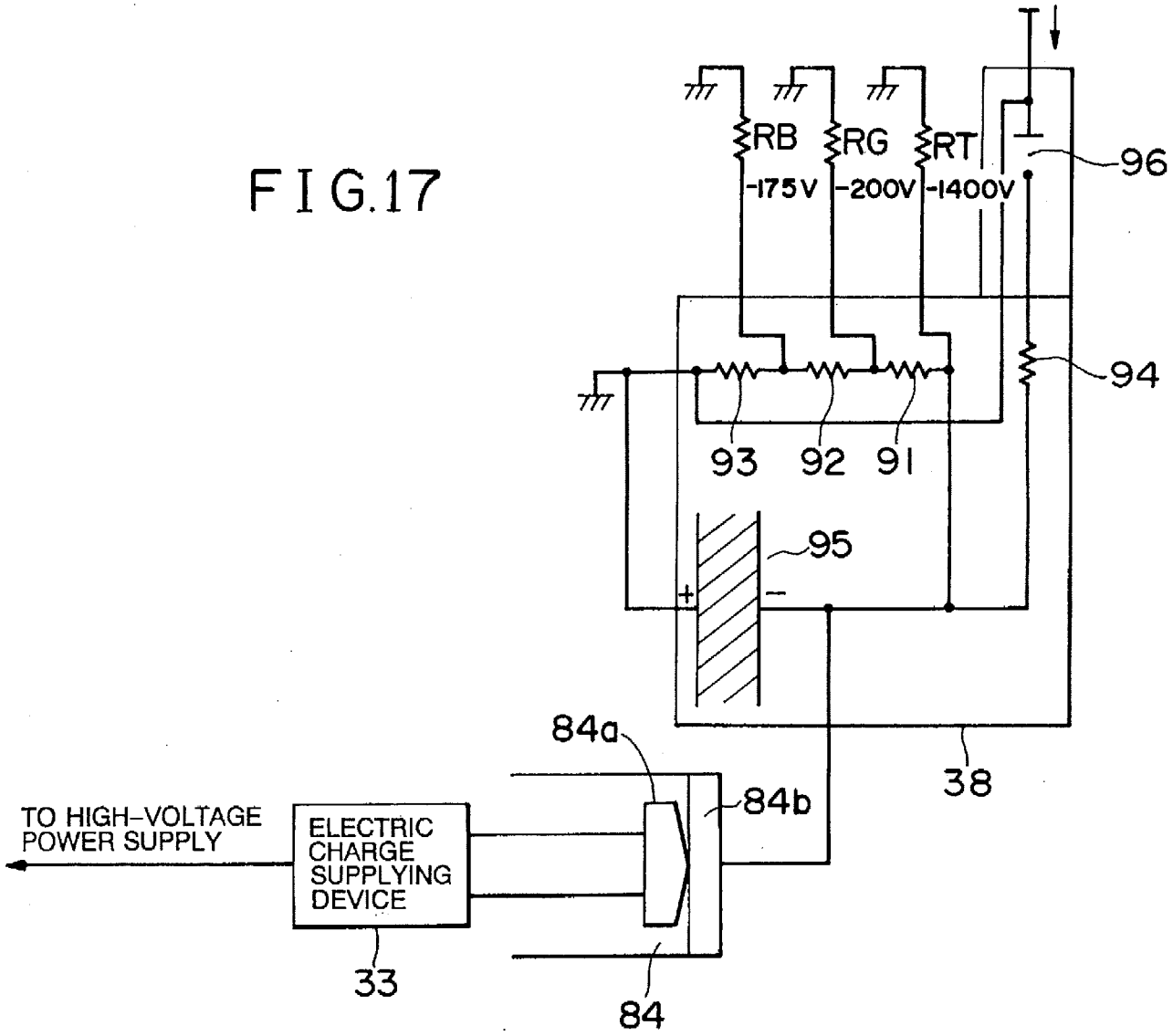
FIG. 17 is a view illustrating a configuration of the electric charge accumulating unit in the embodiment 6.

FIG. 17 is a view illustrating a configuration of the electric charge accumulating unit 38 in the embodiment 6. The electric charge supplying device 33 is connected via the switch 84 to the electric charge accumulating unit 38. The configuration of the switch 84 is the same as the switch in the embodiment 5.

The electric charge accumulating unit 38 includes a capacitor 95, resistances 91, 92 and 93 connected in series and a switch 96 connected in series to a resistance 94 inclusive. One terminal of a capacitor 95 is grounded, while the other terminal thereof is connected to the movable part 84*b*. One terminal of the resistance 93 is grounded and connected to one terminal of the switch 96.

One terminal of the resistance 91 is connected to the movable part 84*b* and is, simultaneously, connected to one terminal of the resistance 94. The resistances 91, 92 and 93 correspond to voltage dividing elements and divide a high voltage applied to the capacitor 95. The voltage divided by the resistance 93 is supplied at, e.g., −175 V to the doctor blade 13. The voltage divided by the resistance 92 is supplied at, e.g., −200 V to the developing roller 6. The voltage divided by the resistance 91 is supplied at, e.g., −1400 V to the charging unit 4.

The capacitor 81, when the carriage 1 is in the start-of-print position, accumulates the electric charge supplied from the electric charge supplying device 33. The capacitor 81, when the carriage 1 is in the execution-of-print position, supplies the accumulated electric charges to the developing rollers 6, the charging unit 4 and the doctor blades 13.

The switch 96 is constructed to interlock with an unillustrated cover provided on an upper portion of the carriage 1. The switch 96 automatically operates to discharge the electric charge of the capacitor for a manipulation in the interior of the carriage 1 during a maintenance.

Note that other configurations are the same as those in the embodiment 5.

<Operation of the Embodiment 6>

Given next is an explanation of the operation of the embodiment 6. To begin with, when the carriage 1 reaches the start-of-print position shown in FIG. 15 by dint of the rotating force of the drive motor 32, the movable part 84*b* of the switch 84 is brought into contact with the fixed part 84*a* thereof. At this time, the electric charge supplying device 33, on receiving the high voltage from the high-voltage power supply 36, supplies the electric charge accumulating unit 38 with the electric charge relative to the high voltage. In the electric charge accumulating unit 38, the electric charges are gradually accumulated in the capacitor 95 by the high voltage.

Then, a predetermined time has elapsed, a sufficient amount of electric charges are accumulated in the capacitor 95, and the carriage 1 again moves in the direction perpendicular to the feeding direction of the chart 8 in order to perform the print.

Hereupon, the moveable part 84*b* of the switch 84 separates from the fixed part 84*a* thereof. The high voltage given by the capacitor 95 is divided by the resistances 93, 92 and 91. The divided voltages are applied to the charging unit 4, the developing roller 6 and the doctor blade 13 which correspond thereto. Herein, the resistances 91, 92 and 93 are well smaller than the resistances of the charging unit 4 and of the developing roller 6. Resistance values are selected so as not to abruptly reduce the electric charge of the capacitor 95.

Accordingly, the bias electric potential can be kept substantially at a fixed level during the print. Further, the high-voltage cable becomes unnecessary, thereby preventing the leakage and the electric shock. Moreover, the voltage is applied to each unit by use of the single piece of switch 84 and the single piece of capacitor 95. Hence, a small number of capacitors may suffice. It is thus possible to attain its down-sizing and provide an inexpensive apparatus.

Further, the switch 96 operates through the resistance 94 and the switch 96 which are provided in the electric charge accumulating unit 38. Hereupon, the electric charge in the capacitor 95 is discharged by the resistance 94. With this operation, the carriage 1 has no residual electric charge, and, hence, the electric shock can be prevented. Further, the discharge can be effected by one resistance 94 and one switch 96, whereby the down-sizing thereof is attainable, and the inexpensive apparatus can be also provided.

Note that the switch 96 may be constructed to interlock with the cover of the electrophotographic apparatus. In this case, when uncovered, the electric charge accumulated in the capacitor 95 is discharged.

Further, in accordance with the embodiment 6, the high voltage is divided by the resistances 91, 92 and 93. For instance, the high voltage may also be divided by connecting, e-g., a plurality of capacitors in series in place of the resistances.

Note that the present invention is not confined to the embodiments discussed above. For example, the electrophotographic apparatus may incorporate supply rollers for supplying or collecting the toners to or from the developing rollers. Even when using these supply rollers, the bias voltages may be applied to the above-mentioned supply rollers.

<Embodiment 7>

Figure 18:
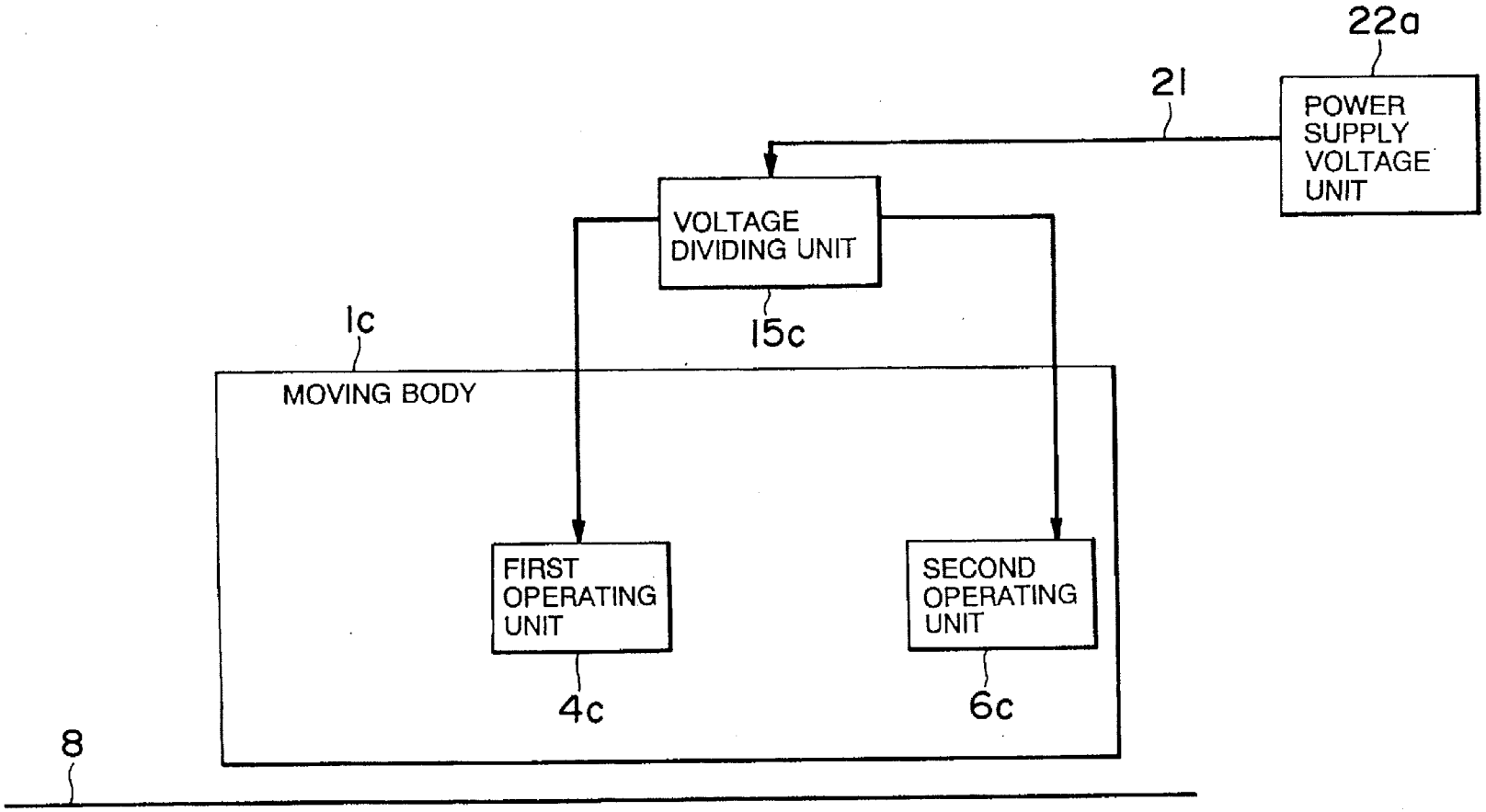
FIG. 18 is a block diagram illustrating a construction of the electrophotographic apparatus in accordance with an embodiment 7 this invention.

Next, an embodiment 7 of the present invention will be discussed. FIG. 18 is a view illustrating a construction of the electrophotographic apparatus in accordance with the embodiment 7 of this invention. The electrophotographic apparatus comprises a moving body 1*c*, a voltage dividing unit 15*c* connected to the moving body 1*c* and a power supply voltage unit 22*a* connected via the cable 21 to the voltage dividing unit 15*c*. The moving body 1*c* includes a first operating unit 4*c* and a second operating unit 6*c*. The moving body 1*c* moves in reciprocation in the direction perpendicular to the feeding direction of the chart 8.

The first operating unit 4*c* and the second operating unit 6*c* are supplied with power supply voltages and thereby operate. The first operating unit 4*c* is, e.g., the charging unit. The second operating unit 6*c* is, e.g., the developing unit.

The power supply voltage unit 22*a* supplies the power supply voltage to the voltage dividing unit 15*c* via the cable 21 in order to supply the first and second operating units 4*c* and 6*c* with the voltages. The voltage dividing unit 15*c*, which moves in synchronism with the moving body 1*c*, divides the power supply voltage given from the power supply voltage unit 22*a* and supplied the divided voltages to the first and second operating units 4*c* and 6*c*.

According to the construction given above, the voltage dividing unit 15*c* moves in synchronism with the moving body 1*c*. Then, the voltage dividing unit 15*c* divides the power supply voltage given from the power supply voltage unit 22*a* and supplies the divided voltages to the first and second operating units 4*c* and 6*c*. The first and second operating units 4*c* and 6*c* mounted on the moving body 1*c* receive the supply of the divided voltages and thereby operate.

Accordingly, the power supply voltage unit 22*a* supplies the first and second operating units 4*c* and 6*c* with the voltages via the single cable 21, and, consequently, the cable-to-cable leakage disappears.

It is apparent that, in this invention, a wide range of different working modes can be formed based on the invention without deviating from the spirit and scope of the invention. This invention is not restricted by its specific working modes except as.

What is claimed is:

1. An electrophotographic apparatus comprising:

a moving body moving in reciprocation in directions perpendicular to a feeding direction of a chart;

an image carrier mounted on said moving body and rotating in synchronism with a movement of said moving body;

charging means, mounted on said moving body, for charging said image carrier;

developing means, mounted on said moving body, for developing an electrostatic latent image formed by irradiating said image carrier charged by said charging means with the light to produce a developed image; and voltage dividing means, moving in synchronism with said moving body, for dividing a predetermined voltage an d supplying the divided voltages to said charging means and said developing means.

2. An electrophotographic apparatus according to claim 1, wherein said voltage dividing means comprises a plurality of resistances coupled in series and fetches the divided voltages from one terminal of said respective resistances.

3. An electrophotographic apparatus according to claim 1, further comprising power supply means for supplying the predetermined voltage via a cable.

4. An electrophotographic apparatus according to claim 1, further comprising:

fixing means, moving in synchronism with said moving body, for fixing the developed image formed on the chart; and driving means for driving said fixing means.

5. An electrophotographic apparatus according to claim 4, wherein said driving means moves in synchronism with said moving body.

6. An electrophotographic apparatus according to claim 4, wherein said driving means comprises:

rectifying means for rectifying alternate current from an AC power supply;

inverter means for converting a direction current into an alternate current; and resonating means, connected to said rectifying means and said inverter means, for effecting a voltage-resonance.

7. An electrophotographic apparatus according to claim 6, wherein said resonating means moves in synchronism with said moving body.

8. An electrophotographic apparatus according to claim 6, wherein said resonating means and said inverter means move in synchronism with said moving body.

9. An electrophotographic apparatus according to claim 6, wherein said resonating means comprises a capacitor and a coil in parallel, said coil heating said fixing means.

10. An electrophotographic apparatus comprising:

an image carrier mounted on a moving body moving in reciprocation in directions perpendicular to a feeding direction of a chart and rotating in synchronism with a movement of said moving body;

charging means, mounted on said moving body, for charging said image carrier;

developing means, mounted on said moving body, for developing an electrostatic latent image formed by irradiating said image carrier charged by said charging means with the light;

electric charge supplying means for supplying electric charges; and holding means, mounted on said moving body, for holding, when said moving body is in a start-of-print position, the electric charges supplied from said electric charge supplying means and applying, when said moving body is in an execution-of-print position, the held electric charges to said developing means and said charging means.

11. An electrophotographic apparatus according to claim 10, wherein a plurality of said holding means are prepared corresponding to at least said developing means and said charging means.

12. An electrophotographic apparatus according to claim 10, further comprising hold voltage dividing means, mounted on said moving body, for dividing an electric potential relative to the electric charge accumulated in said holding means and supplying the divided voltages to said charging means and said developing means.

13. An electrophotographic apparatus according to claim 12, wherein said holding means including:

a switching operating when said moving body is in the start-of-print position and making non-operation when said moving body is in an execution-of-print position; and a capacitor for holding the electric charges supplied form said electric charge supplying means when said switch operates and applying the held electric charges to said developing means and said charging means when said switch makes the non-operation.

14. An electrophotographic apparatus according to claim 12, wherein said hold voltage dividing means comprises a plurality of resistances coupled in series and fetches the divided voltages from one terminal of said respective resistances.

15. An electrophotographic apparatus according to claim 11, wherein said moving body includes:

a resistance; and a switch, connected to said resistance, for discharging the electric charge accumulated in said holding means via said resistance by a manipulation from the outside.

16. An electrophotographic apparatus comprising:

first and second operating units mounted on a moving body and operating when supplied with respective power supply voltages;

a power supply voltage unit for supplying the power supply voltages to said first and second operating units; and voltage dividing means, moving in synchronism with said moving body, for dividing the power supply voltages given from said power supply voltage unit and supplying the divided voltages to said first and second operating units.

* * * * *

UNITED STATES PATENT AND TRADEMARK OFFICE

CERTIFICATE OF CORRECTION

PATENT NO. : 5,673,107

DATED : September 30, 1997

INVENTOR(S) : Syuzou MASUDA

It is certified that error appears in the above-indentified patent and that said Letters Patent is hereby corrected as shown below:

Column 7

Line 27, "V" should be --$V_3$--.

Column 8

Line 26, "C3" should be --C2-C3,--.

Column 11

Line 21, "4aduring" should be --4a during--.

Column 12

Line 23, "84aand" should be --84a and--.

Signed and Sealed this

Twenty-seventh Day of January, 1998

*Attest:*

*Attesting Officer*

BRUCE LEHMAN

*Commissioner of Patents and Trademarks*